US009776312B2

(12) United States Patent
Franz

(10) Patent No.: US 9,776,312 B2
(45) Date of Patent: Oct. 3, 2017

(54) FASTENER DRIVING TOOL

(71) Applicant: Hilti Aktiengesellschaft, Schaan (LI)

(72) Inventor: Karl Franz, Feldkirch (AT)

(73) Assignee: HILTI AKTIENGESELLSCHAFT, Schaan (LI)

( * ) Notice: Subject to any disclaimer, the term of this patent is extended or adjusted under 35 U.S.C. 154(b) by 0 days.

(21) Appl. No.: 15/255,349

(22) Filed: Sep. 2, 2016

(65) Prior Publication Data

US 2016/0368127 A1 Dec. 22, 2016

Related U.S. Application Data

(62) Division of application No. 13/473,854, filed on May 17, 2012, now Pat. No. 9,463,561.

(30) Foreign Application Priority Data

May 19, 2011 (DE) ..... 10 2011 076 087

(51) Int. Cl.
*B25C 1/04* (2006.01)
*B25C 1/06* (2006.01)

(52) U.S. Cl.
CPC ..... *B25C 1/06* (2013.01); *B25C 1/04* (2013.01); *B25C 1/047* (2013.01)

(58) Field of Classification Search
CPC ..... B25C 1/06; B25C 1/04
USPC ..... 173/46, 204; 227/130, 132, 146
See application file for complete search history.

(56) References Cited

U.S. PATENT DOCUMENTS 3,321,033 A * 5/1967 Benuska ..... E01C 23/124 173/204
3,810,572 A * 5/1974 Malkin ..... B25C 1/06 227/131
3,913,685 A * 10/1975 Enstrom ..... B25C 1/06 173/117
3,924,692 A * 12/1975 Saari ..... B25C 1/06 173/117
4,215,808 A * 8/1980 Sollberger ..... B25C 1/041 173/204
5,720,423 A * 2/1998 Kondo ..... B25C 1/04 227/130

(Continued)

FOREIGN PATENT DOCUMENTS

CN 2709119 Y 7/2005
CN 201089151 Y 7/2008

(Continued)

OTHER PUBLICATIONS

German Office Action, Application No. 10 2011 076 087.3, mailed Aug. 6, 2012.
U.S. Appl. No. 13/473,854, filed May 17, 2012.

*Primary Examiner* — Thanh Truong
*Assistant Examiner* — Patrick Fry
(74) *Attorney, Agent, or Firm* — Leydig Voit & Mayer

(57) ABSTRACT

The invention concerns a driving tool comprising a motor, in particular, an electric motor, a gas spring with an elastically compressible gas volume, and a firing piston, wherein the gas spring can be tensioned via a tensioning device with the motor, so as to accelerate after a release from a tensioned state the firing piston in a firing direction, wherein at least one part of the tensioning device is located within the gas volume of the gas spring.

17 Claims, 1 Drawing Sheet

(56) References Cited

U.S. PATENT DOCUMENTS

| | | | | |
|---|---|---|---|---|
| 6,123,241 | A * | 9/2000 | Walter | B25C 1/008 123/46 SC |
| 7,578,420 | B2 * | 8/2009 | Tanimoto | B25C 1/06 227/132 |
| 7,992,756 | B2 * | 8/2011 | Franz | B25C 1/06 227/131 |
| 8,011,441 | B2 * | 9/2011 | Leimbach | B25C 1/047 173/1 |
| 8,763,874 | B2 * | 7/2014 | McCardle | B25C 1/047 227/129 |
| 8,875,969 | B2 * | 11/2014 | Pedicini | B25C 1/04 227/10 |
| 2005/0173485 | A1 * | 8/2005 | Moeller | B25C 1/08 227/10 |
| 2006/0180631 | A1 * | 8/2006 | Pedicini | B25C 1/06 227/130 |
| 2006/0261127 | A1 * | 11/2006 | Wolf | B25C 1/06 227/131 |
| 2006/0283910 | A1 * | 12/2006 | Schiestl | B25C 1/06 227/131 |
| 2008/0237294 | A1 * | 10/2008 | Tanimoto | B25C 1/06 227/129 |
| 2009/0236387 | A1 * | 9/2009 | Simonelli | B25C 1/008 227/8 |
| 2010/0089963 | A1 * | 4/2010 | Franz | B25C 5/15 227/8 |
| 2010/0213235 | A1 * | 8/2010 | Pedicini | B25C 1/047 227/130 |
| 2012/0160888 | A1 * | 6/2012 | Schiestl | B25C 1/06 227/8 |

FOREIGN PATENT DOCUMENTS

| | | | |
|---|---|---|---|
| CN | 101716760 | A | 6/2010 |
| CN | 201808039 | U | 4/2011 |
| DE | 196 29 762 | A1 | 1/1997 |
| DE | 10 2007 000 219 | A1 | 10/2008 |
| DE | 10 2010 063 964 | A1 | 6/2012 |
| WO | WO 2010/044482 | A1 | 4/2010 |

* cited by examiner

FASTENER DRIVING TOOL

CROSS-REFERENCE TO RELATED APPLICATIONS

This patent application is a Divisional Application of U.S. patent application Ser. No. 13/473,854, filed May 17, 2012, which claims the benefit of German Patent Application No. 10 2011 076087.3, filed May 19, 2011, which are each incorporated by reference.

The invention concerns a fastener driving tool, in particular, a hand-held fastener driving tool according to the preamble of claim 1.

BACKGROUND OF THE INVENTION

DE 196 29 762 A1 describes a fastener driving tool to drive a nail into a workpiece, in which tool a gas spring is pretensioned by an electric motor, so as to drive in a firing piston. The tension of the spring can take place in different variants by a spindle, a lever, or the pull of a cable.

BRIEF SUMMARY OF THE INVENTION

It is the goal of the invention to indicate a fastener driving tool, which has favorable structural dimensions.

This goal is attained for a driving tool, in accordance with the invention, mentioned in the beginning and with the characterizing features of claim 1. By the arrangement of at least one part of the tensioning device in the gas volume, the possibility of a considerable reduction of the structural dimensions is given. The elastically compressible gas volume in the sense of the invention is understood to be a volume whose pressure rises in the course of the tensioning of the gas spring.

In one possible embodiment of the invention, both the tensioning device and the motor are located within the gas volume. With particular preference, in this embodiment, the motor is an electric motor, so that in an advantageous design of details, only one feedthrough of electrical lines to the gas volume has to be sealed off.

With one particularly preferred embodiment of the invention, the motor is located outside the gas volume. This ensures a simpler mode of construction and the motor can be easily cooled by outside air.

In a simple and reliable implementation, the tensioning device is thereby preferably connected with the motor via a rotatable shaft, wherein a shaft sealing, which seals off the gas volume, is located on the shaft. The sealing of a shaft relative to a gas pressure is possible in a simple manner—for example, with one or more O rings.

It is generally advantageous that provision be made so that the tensioning device comprises a spindle, preferably a circulating-ball spindle. A circulating-ball spindle makes available a low-friction possibility of a greatly enhanced conversion of a rotational movement into a linear tensioning movement. In an advantageous design of the details, the spindle is located within the gas volume, wherein forces are simply transferred from the spindle to the spring, and a compact design of the driving tool is made possible.

In an alternative or supplementary embodiment, the motor and the spindle are connected directly, wherein the spindle preferably runs on a rotating axle of the motor. A direct connection is thereby understood to mean that a gear is not provided between the motor and spindle. For example, a circulating-ball nut of the spindle can be connected directly with a rotor of the motor and can run around the rotating axle of the motor. It is preferable, although not necessary, if such an arrangement is completely integrated into the gas volume.

In one embodiment alternative to this, the motor and the spindle are connected via a gear element. In a simple and low cost manner, this can be a toothed wheel stage, a belt drive, for example, a toothed belt drive, wherein, at the same time, a desired transmission can be made available. The motor can thereby be located next to the spindle so that space is economized.

In one possible embodiment of the invention, the gas spring has, in the relaxed state, a gas pressure greater than 1 bar. With such a high-pressure gas spring, the compression ratio is reduced in comparison to a gas spring with a low pressure, and thus the energy density is increased and under certain circumstances, the heating by compression is reduced. Preferably, the gas spring, in the relaxed state, has a gas pressure greater than 3 bar, with particular preference, greater than 10 bar. In one particularly preferred embodiment, the gas spring, in the relaxed state, has a gas pressure greater than 30 bar, preferably, greater than 50 bar.

In one possible embodiment of the invention, the driving tool has a temperature sensor to measure the temperature of the gas of the gas spring. The temperature sensor is preferably located within the gas volume. With particular preference, the driving tool has a control that regulates a tensioning stroke of the gas spring as a function of a temperature measured by the temperature sensor. In this way, undesired temperature fluctuations of the gas, for example, by heat removal from the motor, can be balanced out, which, otherwise, influence the driving energy.

In one possible embodiment of the invention, a relaxation movement of the gas spring can be slowed down with the aid of the motor.

BRIEF DESCRIPTION OF THE SEVERAL VIEWS OF THE DRAWINGS

Other features and advantages of the invention can be deduced from the embodiment examples and from the dependent claims. Below, two preferred embodiment examples of the invention are described and explained in more detail with the aid of the appended drawings.

DETAILED DESCRIPTION OF THE INVENTION

Figure 1:
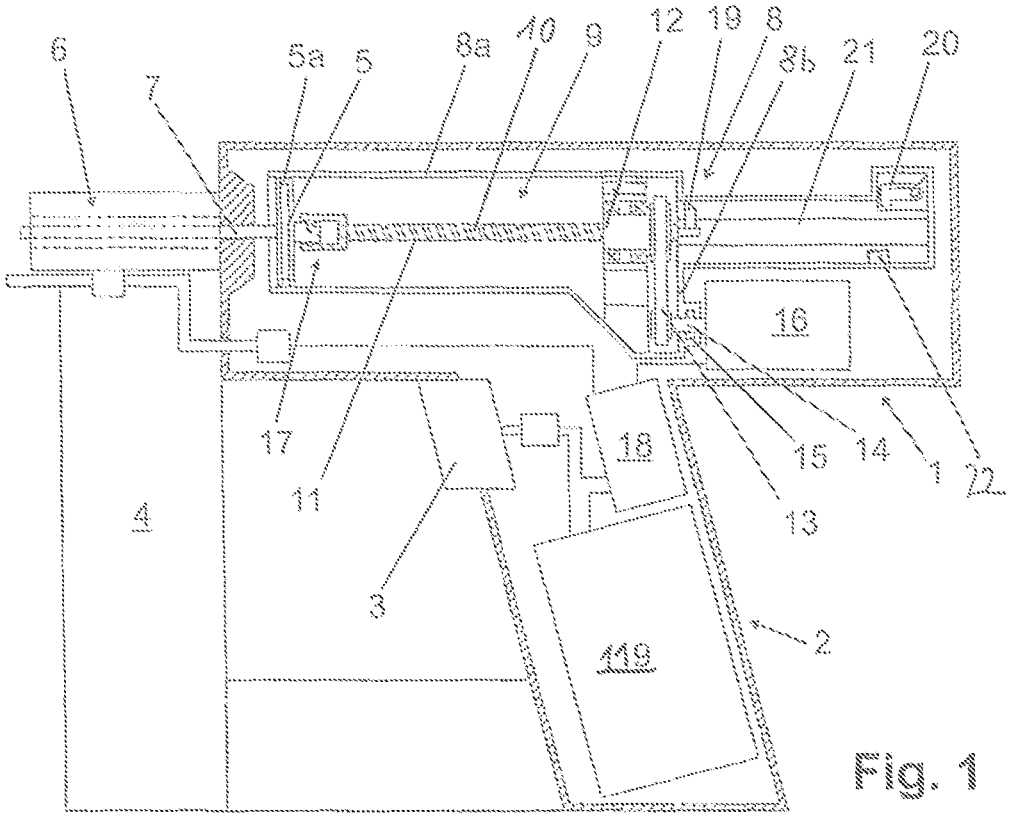
FIG. 1 shows a schematic, sectional view of a first embodiment example of the invention.

The driving tool of the embodiment in accordance with the invention and according to FIG. 1 comprises an outer housing 1 with a grip plate 2 and an actuation element 3 located thereon for an operator. A nail magazine 4 is located on a workpiece-side end, wherein nails from the nail magazine 4 can be driven into a workpiece by means of a firing piston 5 through an exit 6.

A driving rod 7 is located on the firing piston 5, wherein the firing piston 5 is sealed off by means of a sealing 5*a* with respect to the inner wall of a cylindrical section 8*a* of a gas spring 8. The gas spring 8 comprises a closed gas volume 9 surrounded by a housing wall 8*a*, 8*b*. The air found in the gas volume 9 can be compressed elastically by a deflection of the firing piston 5 to the right in accordance with FIG. 1.

A tensioning device 10 for the tensioning of the gas spring is partially located in the gas volume 9 in accordance with the invention. The tensioning device 10 comprises a spindle, an available circulating-ball spindle with a threaded shaft 11 and a circulating-ball nut 12. The circulating-ball nut 12 is mounted stationary and rotatable, wherein it can be rotated via a gear element in the form of a belt drive 13, which is also located in the gas volume 9.

A disk of the belt drive 13 is nonrotatably connected with the circulating-ball nut 12 and the other disk sits on a shaft 14, which penetrates the wall 8*b* of the gas volume. The shaft 14 is supported on this site and is, in particular, sealed off by means of a sealing 15.

The shaft 14 leads to an electric motor 16 located outside the gas volume, by means of which motor, the circulating-ball nut 12 of the spindle 11 is ultimately driven via the belt drive 13 underneath. The electric motor is connected with an energy storage unit 119 via an electronic control unit 18. The control unit is, moreover, connected with an actuation element 3 as a switch.

Furthermore, at its front end, the spindle 11 is connected with the firing piston 5 in a detachable manner via a coupling 17. On a rear, opposite end, the spindle has a lock 19, which can lock in a detachable manner in the relaxed state with a counterpiece 20. The counterpiece 20 is located on the end of a narrow, cylindrical projection 21 of the housing wall 8*b*. Upon tensioning the gas spring 8, the firing piston 5 is moved to the right together with the spindle 11 coupled thereon, under compression of the gas in the gas volume 9, wherein the spindle moves into the projection 21. At the end of the tensioning movement, the lock 19 locks on the counterpiece 20, so that the spindle is held.

From this relaxed state, the firing piston can be released by loosening the coupling 17, whereby it is accelerated to the left and drives a nail into the workpiece via the driving rod 7. The coupling can be detached in a known manner, for example, by further moving the spindle 11 from a tensioned position against a releasing stop or something similar. The detaching of the coupling can be introduced by an actuation of the actuation element 3. After the release or driving-in, the spindle is again moved to its original position and the coupling 17 is locked with the firing piston 5.

Furthermore, the driving tool has a temperature sensor 22 for the measurement of the temperature of the gas of the gas spring 8, which is located within the gas volume 9. Electronic control unit 18 regulates a tensioning stroke of the gas spring 8 as a function of the temperature of the gas measured by the temperature sensor.

Figure 2:
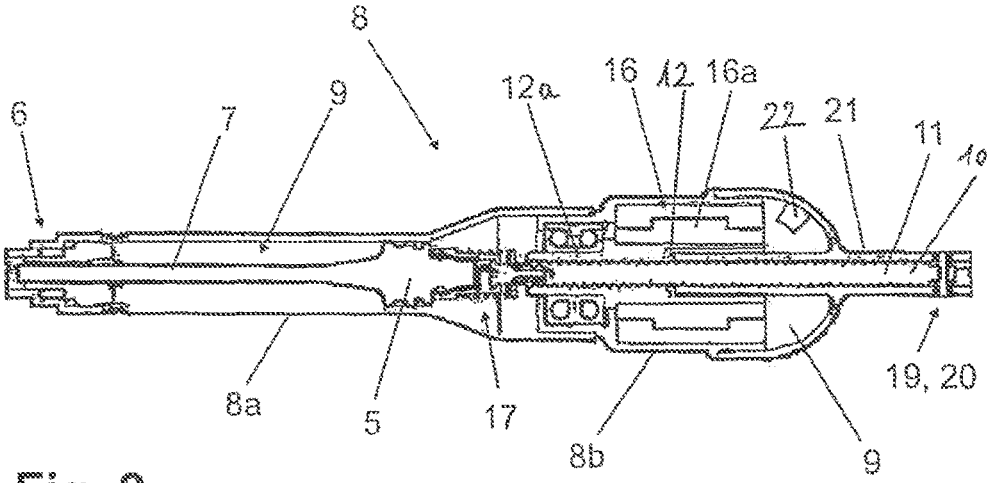
FIG. 2 shows a schematic, sectional view of a second embodiment example of the invention with a motor located in the gas volume.

In the embodiment example shown in FIG. 2, reference symbols are used identically with the same meaning. In contrast to the example according to FIG. 1, not only the spindle 11, but also the electric motor 16 is located within the gas volume 9. FIG. 2 does not show the whole driving tool, but rather only the device with the gas spring 8, the firing piston 5, and the tensioning device 10. Shown is a tensioned state with a firing piston 5 moved maximally to the right. The tensioning device 10, which comprises the spindle 11, a spindle bearing 12*a*, and the coupling 17, is in this example completely located in the gas volume 9.

The circulating-ball nut 12 is directly connected with a rotor 16*a* of the electric motor 16. The spindle 11 extends through the middle of the motor 16 and runs colinearly with its rotating shaft.

In this embodiment, a sealing of a moved mechanical part relative to the housing 8*a*, 8*b* of the gas volume 9 is not required. In any case, the gastight feedthrough of electrical lines must be provided (not shown).

The invention claimed is:

1. A driving tool, comprising an electric motor having a rotatable shaft rotating about an axis of the motor, a gas spring with an elastically compressible gas volume, and a firing piston, wherein the gas spring is tensioned by a tensioning device with the motor, to accelerate the firing piston into a firing direction, after the firing piston is released from a tensioned state, wherein at least one part of the tensioning device is located within the gas volume of the gas spring, the motor is located outside the gas volume, and the tensioning device is connected with the motor via the rotatable shaft, and wherein a shaft seal, which seals off the gas volume, is located on the rotatable shaft.

2. The driving tool according to claim 1, wherein the tensioning device comprises a spindle.

3. The driving tool according to claim 2, wherein the spindle is located within the gas volume.

4. The driving tool according to claim 3, wherein the motor and the spindle are connected, wherein, the spindle runs on a rotating axle of the motor.

5. The driving tool according to claim 3, wherein the motor and the spindle are connected via a gear element.

6. The driving tool according to claim 5, wherein the gear element comprises a toothed wheel stage or a belt drive.

7. The driving tool according to claim 6, wherein the spindle is located offset from the axis of the motor.

8. The driving tool according to claim 2, wherein the spindle is a circulating ball spindle.

9. The driving tool according to claim 1, wherein the gas spring, in a relaxed state, has a gas pressure greater than 1 bar.

10. The driving tool according to claim 1, wherein the driving tool further comprises a temperature sensor for a measurement of the temperature of a gas of the gas spring.

11. The driving tool according to claim 10, wherein the temperature sensor is located within the gas volume.

12. The driving tool according to claim 11, wherein the driving tool further comprises a control unit that regulates a tensioning stroke of the gas spring as a function of a temperature measured by the temperature sensor.

13. The driving tool according to claim 10, wherein the driving tool further comprises a control unit that regulates a tensioning stroke of the gas spring as a function of a temperature measured by the temperature sensor.

14. The driving tool according to claim 1, wherein a relaxing movement of the gas spring is slowed down with the aid of the motor.

15. The driving tool according to claim 1, wherein the gas spring, in a relaxed state, has a gas pressure greater than 3 bar.

16. The driving tool according to claim 1, wherein the gas spring, in a relaxed state, has a gas pressure greater than 10 bar.

17. The driving tool according to claim 1, wherein the gas spring, in a relaxed state, has a gas pressure greater than 30 bar.

* * * * *